United States Patent [19]

Fullmer

[11] Patent Number: 4,558,808

[45] Date of Patent: Dec. 17, 1985

[54] CHAIN SAW CARRYING BACKPACK

[76] Inventor: Paul H. Fullmer, 485 S. 300 East, Cedar City, Utah 84720

[21] Appl. No.: 555,210

[22] Filed: Nov. 25, 1983

[51] Int. Cl.[4] ..... A45F 3/10

[52] U.S. Cl. ..... 224/270; 224/209; 224/210

[58] Field of Search ..... 224/210, 209, 151, 211, 224/153, 213, 214, 215, 212, 234, 155, 202, 203, 907, 268, 270; 211/126, 135; 206/349, 549; 414/406

[56] References Cited

U.S. PATENT DOCUMENTS

| | | | |
|---|---|---|---|
| 947,024 | 1/1910 | Paine et al. | 224/270 |
| 1,714,819 | 5/1929 | Rhodes | 224/212 |
| 2,738,909 | 3/1956 | Shadoin et al. | 224/202 |
| 2,742,212 | 4/1956 | Siftar | 224/212 X |
| 2,841,317 | 7/1958 | Elden | 224/210 |
| 2,925,205 | 2/1960 | Hunt | 224/270 X |
| 2,967,649 | 1/1961 | Mack | 224/270 X |
| 3,099,374 | 7/1963 | Henke | 224/208 X |
| 3,127,077 | 3/1964 | Faro | 224/214 X |
| 3,207,395 | 9/1965 | Dunn | 224/210 |
| 3,283,971 | 11/1966 | Jones | 224/202 X |
| 3,516,585 | 6/1970 | Inwood | 206/349 X |
| 3,549,064 | 12/1970 | Wilson | 224/209 X |
| 3,881,644 | 5/1975 | Demaline | 224/153 |
| 3,940,040 | 2/1976 | Haulter | 224/151 |
| 4,120,434 | 10/1978 | Hewes | 224/249 |
| 4,248,367 | 2/1981 | Buel | 224/153 |
| 4,362,307 | 12/1982 | Nakatani | 224/153 X |
| 4,431,121 | 2/1984 | Bensette | 224/153 |

*Primary Examiner*—Stephen Marcus
*Assistant Examiner*—Robert Petrik
*Attorney, Agent, or Firm*—Trask & Britt

[57] ABSTRACT

A support assembly adapted to carry a power chain saw therein is disclosed. The assembly presents a shelf-like configuration which houses the saw. An opening in the assembly dimensioned to accommodate the handle of the saw acts to retain the saw on the shelf. The assembly is adapted for mounting on a back-carried frame structure.

10 Claims, 5 Drawing Figures

CHAIN SAW CARRYING BACKPACK

BACKGROUND OF THE INVENTION

1. Field

This invention is directed toward a backpack structure which can be carried on the back of its wearer. Specifically, the invention is drawn to a backpack adapted to carry a power chain saw.

2. State of the Art

Presently, the power chain saw enjoys considerable use in a diversity of applications. Fire suppression, trail maintenance, fence construction, tree planting, logging, surveying or simple firewood gathering illustrate but a few of the activities wherein this device has proven useful. A large number of these applications occur in remote locations. Oftimes, owing to the location's remoteness, the saw operator is required to carry the saw to the worksite either on his person or by pack animal.

The carrying of a chain saw from point to point presents a problem due to its size, weight and unwieldly nature. Furthermore, the hazards owing to its sharpened blade elements require special attention. Not only may the blade be extensively damaged if it is accidentally dropped to the ground, but the transporter himself may be injured by falling against an exposed blade.

Conventional practice has included the use of carrying cases adapted structurally to secure a chain saw. Such cases typically provide a handle thereon, permitting the transporter to carry the case by hand. These cases fail to provide an adequate structure for transporters who venture into remote wilderness areas. Not only is the transporter's maneuverability hampered by the functional loss of one or both of his hands, but furthermore, the case is not positioned on the transporter's person for a balanced and convenient transport.

The use of back-carried structures adapted for the transporting of articles is of ancient origin. As a result, the art of backpack making has experienced considerable attention.

Backpacks which are not specifically directed to chain saw transport, but nevertheless disclose structure germane to backpack construction are: U.S. Pat. No. 2,836,334 (Davis); U.S. Pat. No. 3,127,077 (Faro); U.S. Pat. No. 3,265,260 (Romney); U.S. Pat. No. 2,563,195 (Soule, et al); U.S. Pat. No. 3,659,760 (Blood); U.S. Pat. No. 2,742,212 (Siftar) and U.S. Pat. No. 2,675,150 (Ackerman).

The adaptation of a back-carried structure for the transporting of power chain saws is disclosed in U.S. Pat. No. 3,207,395 (Dunn) and U.S. Pat. No. 2,841,317 (Elden).

Common to both Dunn and Elden devices is a reliance on suspension-type mountings to secure the saw to the back-carried fraxe. In Dunn, a backpack frame is fitted with a clamp-like assembly. The assembly functions to clasp the chain saw on a portion of its blade. The remaining structure of the saw, being depended from the blade, is maintained in a suspended position. Further teachings as to suspension-type mountings are available from Elden wherein the use of a rod-like cross-bar, from which a chain saw may be suspended, is described.

SUMMARY OF THE INVENTION

A backpack structure adapted to carry a power chain saw has been invented. The invention includes as its main structural elements a back-carried frame and a shelf-like support assembly.

The back-carried frame may involve either of two related configurations wherein certain elements are structurally distinct. The first configuration presents an assemblage of tubular elements, a plurality of such elements being arranged vertically to form a series of upright members. These members are securely joined to a plurality of tubular elements oriented in a horizontal manner, the horizontal members serving as cross bracing. The conjunction of vertical and horizontal members defines a sturdy mounting surface upon which additional structure may be assembled. This assemblage-type frame may be suitably adapted for positioning on the wearer's back or on a pack animal by including a pair of shoulder straps mounted on the frame itself. These straps may be configured, attached, and adjusted after the manner known in the conventional art.

The second frame configuration retains a plate-like surface member as its main structure. The plate-like surface is rendered carryable on the transporter's back by the mounting of shoulder straps on the surface itself. The straps are made adjustable, in the sense that provision of a plurality of upper strap mounting locations allows the wearer to select from a variety of strap-frame configurations. This adjustability is facilitated by the placement of two vertically oriented parallel rows of slotted openings within the planiform surface member. These slotted openings are dimensioned to receive individually a shoulder strap. The shoulder strap, after passing through the opening, inter-cooperates with additional structure to yield a manually detachable union of the strap with the planiform surface. By choosing from the available slotted openings, the wearer can select a strap-frame configuration best suited for his individual carrying abilities and requirements.

The shelf-like support assembly includes a vertically disposed rear sidewall panel adapted with means of securing itself, together with its associated assembly structure, to the back-carried frame. The rear panel may assume a variety of configurations. The rear sidewall panel may be dimensioned sufficiently to function jointly as an aforementioned horizontal cross bracing member. The panel could be integrated into the frame assembly by either providing additional mounting structure or, alternately, shaping the panel to permit adhesive attachment.

A bottom member is secured to the rear member preferably at about a right-angle, presenting thereby a shelf-like structure. The bottom member is provided with an aperture therein of suitable dimensions to receive and accommodate the handle portion of a power chain saw. The opening is preferably oriented in the central region of the bottom member with its length directed outward from the wearer's back; i.e., the longitudinal axis of the opening is oriented substantially perpendicular to the backpack frame. This opening orientation functions to direct the saw to a somewhat vertical positioning. The base or motor unit of the saw, being contiguous with the handle, is rested on the bottom member as a result of the handle's insertion through the opening. The saw blade, projecting from the motor unit, is oriented vertically upward owing to the chainsaw handle being stabilized within the bottom member aperture.

The conjunction of rear member and bottom member, with appurtenant aperture, presents in effect a shelf adapted with a mounting well. Additional stability may be provided to the shelf by a plurality of vertically disposed sidewall panels assembled around the bottom member and secured thereto. The conjunction of sidewall panels with the bottom member presents an open-ended box-like housing structure. The spacing of the sidewall panels is arranged to permit the accommodation of a chain saw motor assembly therebetween. Stability may also be obtained by positioning a restraining means; e.g. a flexible strap, a rigid bar, or an enclosed well-like structure, under the shelf support assembly. This restraining means can intercooperate with the chain saw handle to maintain that handle within the mentioned aperture.

The back-carried frame with its attached support assembly is adapted with leg supporting means. Such means extend vertically downward beyond the support assembly to provide a support for the backpack upon its placement on the ground. The leg means are dimensioned so as to generally prevent the inserted chain saw handle from contacting the ground, thus ensuring the maintenance of the chain saw within the support assembly.

The utility of the frame-support assembly may be enhanced by requiring the mounting of pocket-like constructions on the sidewalls framing the box-like structure. The pockets being either of flexible or rigid material provide a storage area for auxiliary equipment, maintenance tools and/or fuel supplies.

BRIEF DESCRIPTION OF THE DRAWINGS

In the drawings, which illustrate that which is presently regarded as the best mode for carrying out the invention.

DESCRIPTION OF THE ILLUSTRATED EMBODIMENTS

Figure 1:
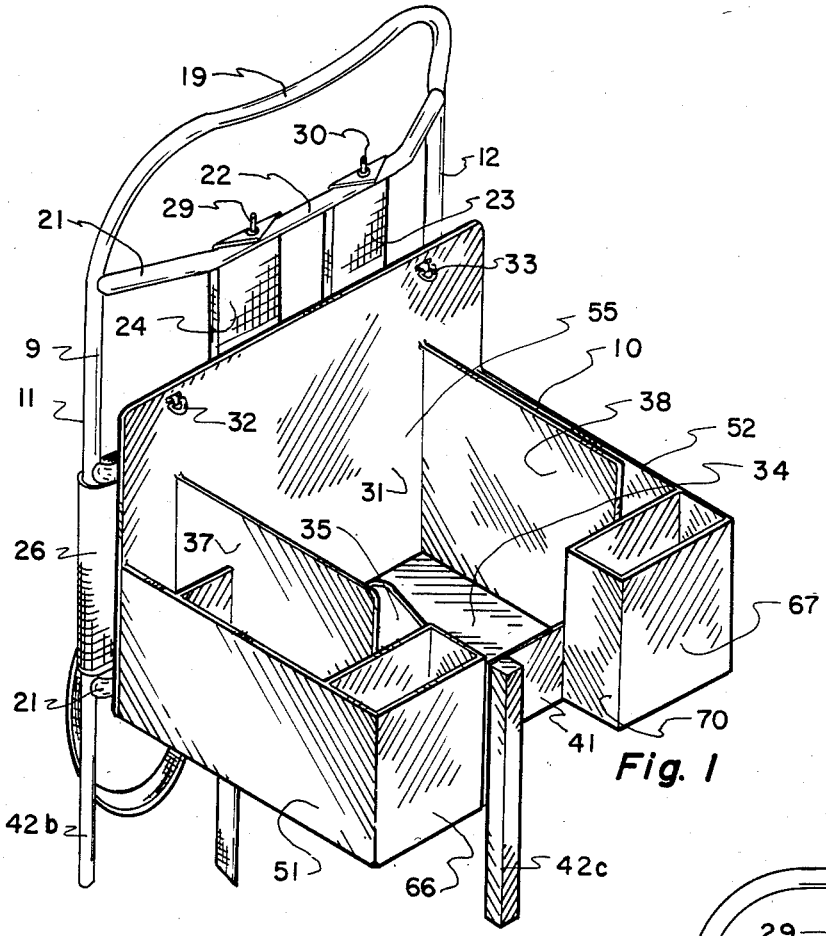
FIG. 1 is a perspective view of a backpack carrier for a chain saw constructed in accordance with the principles of the invention.

The backpack of this invention features in a preferred embodiment a tubular frame assembly, generally denoted 9 and an attached box-like support assembly, generally denoted 10.

The frame assembly 9 includes a pair of vertically disposed upright members 11, 12. In mounting the saw on the backpack, the motor casing is oriented toward the lower reaches of the frame. The blade which extends from the casing is positioned vertically, being directed towards the upper portions of the backpack. Oftimes, the blade is of a length which rises above the structure of the backpack. The upper portion of the frame assembly may be adapted to protect the wearer from accidental contact with the chain saw blade. Protection for the wearer, especially against head injuries, is provided by a safety bar 19. This bar, as shown in the preferred embodiment, may include an upwardly directed extension of upright members 11, 12 in an inclined curvilinear fashion. The uprights are integrated to present a generally "U"-shaped configuration.

Engaging the uprights in a generally horizontal manner is a plurality of arched cross bracing members 21. The concave portions of members 21 are positioned towards the wearer's back, providing thereby a construction which generally conforms to the wearer's skeletal structure for enhanced comfort and balance. The cross bracing members 21 are securely mounted at their intersection with the uprights 11, 12, forming thereby a rigid frame structure. Mounted on the uppermost cross brace 22 are the proximal ends 29, 30 of two shoulder straps 23, 24. The straps, being configured in a manner known in the conventional art, are fitted with buckles 25 for adjusting the length of the straps achieving thereby a comfortable and balanced weight distribution. The distal end **29*a* of strap 23 is mounted on the lower reaches of upright member 12. Strap 24 is mounted in a similar fashion on upright 11**. The described strap mounting provides a securely attached shoulder support for positioning as well as maintaining the backpack on the wearer's back.

A fabric support member 26 encircles the tubular frame 9, thereby presenting a flexible restraint surface interfacing the frame and the wearer's back.

Mounted vertically on the convex sides of the arched cross braces is a rear sidewall member 31. Rear member 31 may be configured in a variety of surface contours; e.g. curvilinear, planiform. As shown, member 31 presents a planiform surface. Attached to the surface on its upper reaches are two attachment rings 32, 33. The rings are adapted to receive and secure an optional safety strap (not shown) which may be used to retain the transported chain saw in its mounting well. A bottom surface member 34 is fixedly engaged to mounting surface 31, resulting in a shelf-like configuration. Bottom member 34 may assume a somewhat plate-like appearance, and like rear member 31, may be structured in a variety of surface contours; e.g. curvilinear, planiform. The preferred embodiment illustrates a planiform bottom surface member 34. As shown, the bottom member generally obtains dimensions of approximately nine inches in width by approximately eleven and one-half inches in length. Another configuration may include a concave orientation; the concave basin formed thereby providing a nest-like housing for retaining the saw. The mounting of bottom member 34 on rear member 31 may be accomplished under a variety of orientations. As shown, the mounting is executed perpendicularly presenting thereby an approximately "L"-shaped juncture. Alternately, the right-angle mounting may be modified to present either a moderately acute or obtuse angle juncture. These angles are referenced from the vertical, with a 0° angle defined as extending vertically upward. Bottom surface 34 is adapted by the inclusion therein of an aperture 35 which is sized and shaped to receive and embrace the handle of a power chain saw (not shown). The aperture 35 serves to define, in effect, a mounting well for the handle.

Figure 3:
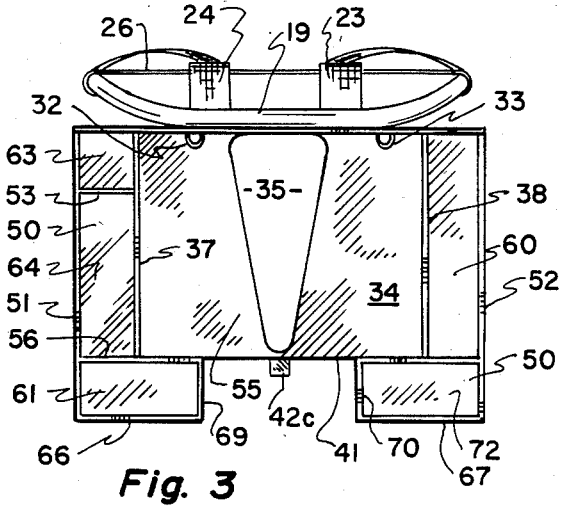
FIG. 3 is a top view of the backpack showing the opening in the bottom panel as well as the mounted pockets.
Figure 2:
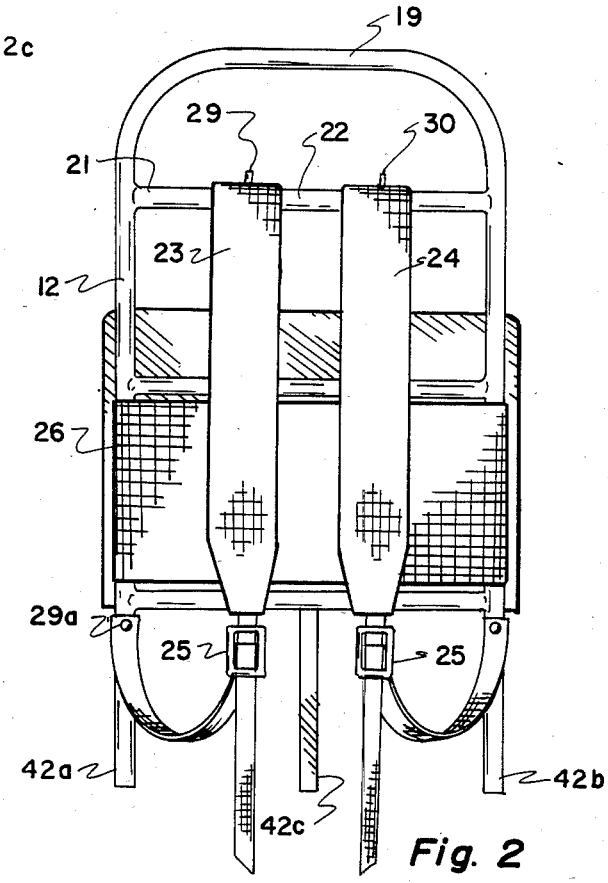
FIG. 2 is an elevational view of a backpack of this invention illustrating the shoulder strap placement.

Typically, the aperture may assume a variety of shape configurations, the preferred being an approximately triangular shape, as shown in FIG. 3. Aperture 35 may have a generally isosceles shape with the base of the triangle positioned parallel to the rear member 31. The opening generally retains a triangle base measurement of approximately four inches and a triangle height of approximately nine inches. Slight changes may be made to such dimensions without affecting the utility of the structure. Aperture 35 in the preferred embodiment is circumscribed either completely by bottom member 34, or alternately by bottom member 34 in conjunction with either or both rear member 31 and front member 41. This triangular aperture adapts the backpack for almost universal usage with presently existing models of chain saws.

A second aperture configuration presents a somewhat rectangular appearance. The length of the rectangle is directed outwardly away from the plane of rear member 31. The resulting configuration approximates that illustrated in FIG. 3 with the exception of replacing the triangular shape with that of a rectangle. The rectangular aperture may generally obtain a width of approximately one inch with the length remaining at approximately eight inches. The use of a rectangonal aperture restricts the assembly's functionability to a limited number of chain saws in contrast to the universality of the triangular aperture. Oblate apertures may be used wherein one oval end has a smaller radius of curvature than the other end.

Typically, the aperture's dimensions range from about one to about five inches in width and seven to ten inches in length (height). The longer aperture lengths are facilitated by increasing the bottom member dimensionally. The aperture's shape as well as dimensions may be modified specifically to accommodate a particular chain saw or a limited number of such saws.

An additional degree of stability for the mounted chain saw may be obtained by the placement of an enclosed well structure on the lower surface of the bottom member 34. This enclosed well may be accessed by the same means as the aperture. The well presents a series of restraint surfaces adapted to laterally restrain the movements of the embraced saw handle. Thereby, the structure would ensure retention of the saw handle within the aperture.

In FIG. 1, attached to the mounting surface 31 in a vertically aligned fashion are a pair of inner sidewall members 37, 38. The sidewall members 37, 38 may assume a variety of surface contours; e.g. curvilinear, planiform.

The mounting of these sidewalls may be accomplished in either of two constructions. The first configuration would space the sidewalls a sufficient distance apart to permit the motor casing to accommodate itself therebetween while coming to rest on the shelf itself; i.e. the sidewalls would function principally to restrain any laterally directed motion of the saw while the shelf would provide a vertical restraint surface as well as contribute the stabilizing function of its mounting well.

As shown, the sidewalls 37, 38 are planiform structures arranged in parallel. The sidewalls 37, 38 in FIG. 4 generally reach a height of approximately eight and one-half inches over a length of approximately nine inches.

An alternate configuration would reduce the distance separating the sidewalls. Moreover, the walls would be oriented so as to present an inclined surface to the inserted motor casing. This configuration results in a funnel-like structure in which the motor casing actually rests on the inclined surfaces of the sidewalls. The sidewalls would thereby provide a laterally directed as well as vertically directed support for maintaining the chain saw in place. The bottom member would function only to contribute the stabilizing action of its mounting well. The resulting configuration precludes the base of the saw from reaching or resting upon the bottom member 34, though the handle is inserted through aperture 35.

Mounted opposite the rear sidewall member 31 in a manner generally parallel to that member is a forward wall member 41. Forward wall member 41 is dimensioned to restrain a directionalized movement of the chain saw perpendicular to the wearer. In the embodiment shown in FIG. 1, member 41 has a height of approximately three inches over a length of approximately eleven inches. The conjunction of the two sidewalls 37, 38, the rear sidewall member 31, the forward wall member 41 and the bottom surface member 34 defines a boxlike assembly, generally denoted 55, suitably adapted for receiving and securing the base assembly of a power chain saw.

The conjunction of the box-like support assembly 55 and its frame 9 is provided with a leg support assembly, generally denoted 42. The leg assembly maintains the conjunction in a standing position upon the placement of that conjunction on the ground. Specifically, the legs are configured to prevent the dislodgement of the inserted chain saw handle from its mounting. A variety of leg configurations as well as orientations may accomplish this result. The totality of legs may be affixed solely to either the frame or the shelf-like assembly or alternatively the mounted legs may be distributed jointly over both structures.

Figure 4:
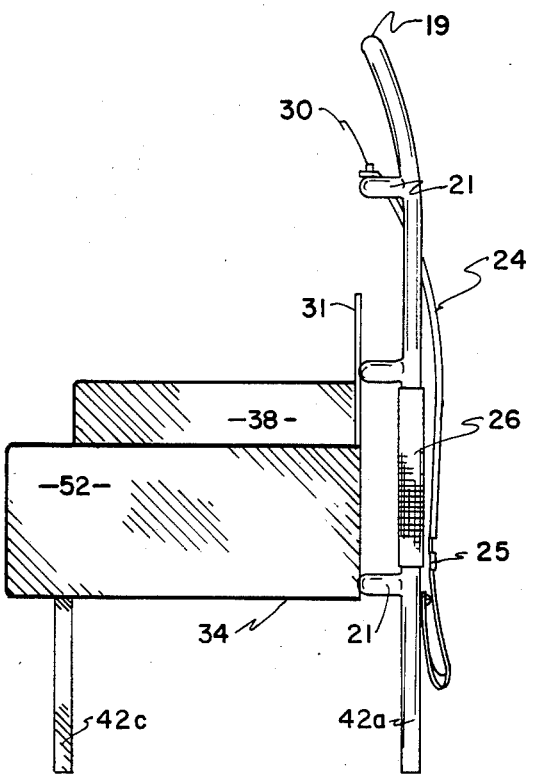
FIG. 4 is a side elevational view of a backpack which illustrates the leg members mounted on the backpack assembly.

In a preferred embodiment, vertically disposed upright members 11, 12 are extended downwardly beyond the main frame structure, thereby forming a pair of support legs 42*a*, 42*b*. The forward wall member 41 provides a mounting surface for a third leg member 42*c*. This leg member 42*c* extends downwardly as shown in FIG. 4, and in conjunction with legs 42*a*, 42*b* completes a tripodal support assembly for the backpack. The legs 42*a*, 42*b*, 42*c* are dimensioned so that their lengths extend below the lowermost portion of the bottom member 34 a sufficient distance to exceed the chain saw handle as that handle protrudes from the elongated aperture in the bottom surface member 34. In that chain saw handles generally obtain lengths of four to six inches, typical support legs are dimensioned longer than six inches. Preferably, the legs extend seven inches beyond the lowermost portion of the bottom surface member. As a result of the leg support assembly, the backpack generally avoids the destabilizing effect of the handle contacting the ground when the backpack is placed on the ground.

Secured to the sidewalls 37, 38 as well as to the forward wall member 41 is a plurality of box-like pockets, generally 50. As shown, the pockets are formed by the provision of a pair of outer sidewalls 51, 52 arranged in a fashion parallel to their respective inner sidewalls 37, 38. The outer sidewalls extend to fixedly engage the bottom surface member which forms the floor surface of the pocket. FIG. 3 shows the forward wall 41 having a length which extends beyond the length required to frame the box-like assembly 55. The forward wall 41 is brought into abutment with outer sidewalls 51, 52 thereby providing a wall surface 56 for pockets 60, 61. The pocket arrangement framed by sidewall 51 is compartmentalized by the inclusion of a partition surface 53 which serves to identify pockets 63, 64.

Mounted vertically on bottom surface 34 in a manner perpendicular to outer sidewalls 51, 52 and parallel to forward wall 41 is a pair of outer forward wall members 66, 67. The outer forward walls being mounted on outer sidewalls 51, 52 respectively are also fixedly engaged respectively with a pair of auxiliary sidewalls 69, 70. The configuration including sidewalls 51, 52; auxiliary sidewalls 69, 70; forward wall 41; outer forward walls 66, 67 and bottom member, 34 defines two distinct pockets 61, 72.

Figure 5:
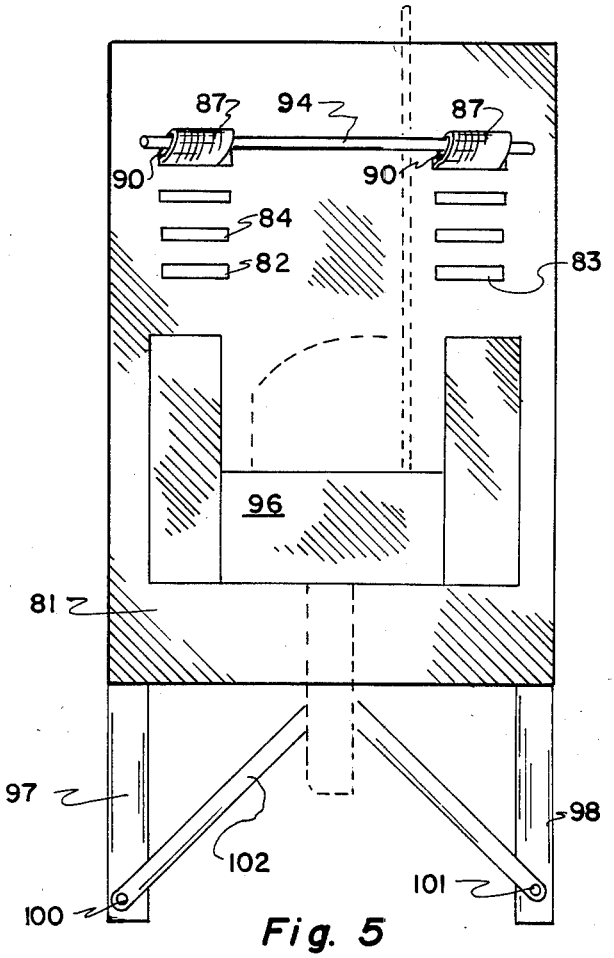
FIG. 5 is a perspective view of a backpack of this invention incorporating a planar frame. The adjustable shoulder strap assembly is detailed. A selected portion of the leg support assembly is illustrated. A retained chain saw is shown in phantom.

FIG. 5 illustrates a backpack frame 81 which is essentially planar in configuration. The frame is dimensioned to have sufficient surface area to accommodate a chain saw support assembly while also providing a protective surface against an accidental contact of the vertically positioned chain saw with the wearer's person.

Illustrative of such a protective surface is the vertical extension of the planiform surface above the support assembly mounting to a height sufficient to preclude an accidental contact of the saw blade with the wearer's person.

The frame 81 presents two vertical rows 82, 83 of horizontally oriented, slotted openings, generally denoted 84. Openings 84 are dimensioned to permit the insertion therethrough of shoulder straps 87. The shoulder straps 87 are adapted with loop-like ends 90, which define openings of sufficient dimensions to accommodate the insertion therethrough of a rod-like member 94.

A manually detachable union of shoulder straps 87 and planar frame 81 is obtained by inserting the straps through the openings 84 in a horizontally aligned manner. The direction of insertion is from the side of the planar frame contacting the wearer's back to the side of the frame presenting the support assembly. Once inserted, the loop-like ends mounted on the shoulder straps are aligned to form a non-continuous horizontal channel. Rod-like member 94 is then inserted through the channel effectively preventing the withdrawal of the shoulder straps through their respective openings.

The shelf-like support assembly, denoted 96, maintains the same structural configurations as that described previously for the tubular element frame 9. An exception does exist in that the rear member 31 is integrated into the planar frame 81 in this second embodiment.

A pair of support legs 97, 98 are shown as depended from the lower edge of the frame 81. Secured to legs 97, 98 at respective locations 100, 101 is a restraining strap 102. This strap intercooperates with the inserted chain saw handle providing thereby additional stability for maintaining the saw in its mounting well.

I claim:

1. A backpack for a chain saw comprising:

a backpack tubular frame assembly having a plurality of vertically disposed tubular members and a plurality of horizontally disposed cross bracing tubular members, a pair of said vertically disposed tubular members extending below the lowermost cross bracing tubular member a sufficient distance to form a pair of first leg members;

a box-like chain saw support assembly having:

a substantially planar vertical rear member having means to attach a box-like assembly to said tubular frame, a pair of inner sidewall members vertically aligned and abutting against said vertical rear member, said sidewall members being substantially parallel to one another and spaced a sufficient distance apart to receive a chain saw motor therebetween, a bottom planar member joined to said sidewall members to form a floor for said box-like assembly, said bottom member having a substantially horizontally oriented elongated opening therein having a longitudinal axis oriented substantially perpendicular to said backpack frame, said aperture adapted to receive the handle of a chain saw such that the base of the chain saw motor adjacent the handle, upon insertion of said handle through said aperture, rests on the bottom member, and a forward wall member joining the forward portions of the bottom member and the sidewall members, said forward wall member having sufficient height above the bottom member to prevent a chain saw lodged within the box-like assembly with its handle protruding through the bottom member from being dislodged in a forward direction; and a third leg member, attached to said box-like assembly and positioned with respect to said two first leg members to provide a stable support for said backpack when it is rested upon the ground.

2. The backpack according to claim 1 wherein said frame assembly includes a head protecting top bar fixedly mounted on the top of said frame assembly, said top bar being configured in an inverted "U"-shape which is inclined away from the wearer's back.

3. A backpack for a chain saw comprising:

a backpack frame assembly having:

a substantially planar vertical member, and a pair of shoulder straps mounted on said vertical member; and a box-like chain saw support assembly having:

a pair of inner sidewall members vertically aligned and abutting against said vertical member, said sidewall members being substantially parallel to one another and spaced a sufficient distance apart to receive a chain saw motor therebetween, an essentially horizontally oriented bottom planar member joined to said sidewall members to form a floor for said box-like assembly, said bottom member having an elongated opening therein having a longitudinal axis oriented substantially perpendicular to said backpack frame, said opening being formed to permit the insertion therethrough of the handle of a chain saw such that the base of the chain saw motor adjacent the handle, upon insertion of said handle through said aperture, rest on the bottom member, and a forward wall member joining the forward portions of the bottom member and the sidewall members, said wall member, said bottom member, said sidewall members and said vertical member in conjunction defining a box-like assembly with four vertical, interconnected walls, said forward wall member having sufficient height above the bottom member to prevent a chain saw lodged within the box-like assembly with its handle protruding through the bottom member from being dislodged in a forward direction.

4. The backpack according to claim 3 wherein said frame assembly includes a pair of vertically disposed, laterally spaced upright members depended from the lower edge thereof, said upright members extending below the vertical member a sufficient distance to form a first leg member and a second leg member, and wherein said support assembly includes a third leg member attached to said forward portion of said box-like assembly, said third leg member being adapted to provide in conjunction with said pair of first leg members a stable support for said backpack when it is rested on the ground.

5. The backpack according to claim 4 wherein said planar vertical member contains a plurality of slot-like apertures arranged in vertical rows, each of said slot-like apertures being adapted in size and shape to permit the insertion therethrough of a shoulder strap; and wherein a rod-like member adapted to intercooperate with each of said shoulder straps whereby said shoulder straps, upon their insertion through said slotted apertures and their intercooperation with said rod-like member, are prevented from being withdrawn through said slot-like apertures, thereby forming a manually detachable union of said shoulder straps with said planar vertical member.

6. The backpack according to claim 5 wherein the ends of said shoulder straps adapted for insertion through said slot-like apertures are formed in a loop-like configuration, said configuration permitting said rod-like member to be inserted therethrough to form a manually detachable union of said straps and said rod-like member.

7. The backpack according to claim 6 wherein said planar vertical member is dimensioned such that at least a portion of the top edge of the vertical member extends to a height sufficient to protect the wearer's head from contact with the transported chain saw blade.

8. A chain saw carrying assembly for mounting on a backpack frame comprising:

a substantially planar vertical rear member having attachment means for attachment to said backpack frame;

a pair of sidewall members approximately vertically disposed and abutting against said vertical rear member;

a bottom planar member joined substantially perpendicularly to said rear member to form a floor for said assembly, said bottom member having a circumscribed aperture having a longitudinal axis oriented substantially perpendicular to said backpack frame, said opening being adapted in size and shape to permit the insertion therethrough of the handle of a chain saw such that the base of the chain saw motor adjacent the handle, upon insertion of said handle through said aperture, rests on said bottom member; and a forward wall member joining the forward portions of the bottom member and the sidewall members to provide said assembly with four vertically interconnected walls, said forward wall member having sufficient height above the bottom member to prevent a chain saw lodged within said assembly with its handle protruding through the bottom member from being dislodged in a forward direction.

9. The assembly according to claim 1 wherein said aperture in said shelf like member is configured approximately into a triangular shape, said aperture being adapted to receive the handle of a chain saw such that the base of the chain saw adjacent the handle rests on said bottom member.

10. The assembly according to claim 1 wherein said aperture in said shelf-like member is configured approximately into a rectangular shape, said aperture being adapted to receive the handle of a chain saw such that the base of the chain saw adjacent the handle rests on said bottom member.

* * * * *